US008695942B2

(12) United States Patent
Dawes

(10) Patent No.: US 8,695,942 B2
(45) Date of Patent: Apr. 15, 2014

(54) VEHICLE LIFT

(76) Inventor: Michael Graham Dawes, Cambridge (GB)

( * ) Notice: Subject to any disclaimer, the term of this patent is extended or adjusted under 35 U.S.C. 154(b) by 0 days.

(21) Appl. No.: 13/466,096

(22) Filed: May 7, 2012

(65) Prior Publication Data

US 2013/0020541 A1 Jan. 24, 2013

(30) Foreign Application Priority Data

Jul. 18, 2011 (GB) ..... 1112349.4

(51) Int. Cl.
*B66F 7/26* (2006.01)

(52) U.S. Cl.
USPC ..... 254/45; 254/88; 254/90; 254/91

(58) Field of Classification Search
USPC ..... 254/45, 88, 90, 91
See application file for complete search history.

(56) References Cited

U.S. PATENT DOCUMENTS

| | | | | |
|---|---|---|---|---|
| 3,804,206 | A * | 4/1974 | Bubik | 254/88 |
| 5,641,150 | A * | 6/1997 | Rober | 254/88 |
| 5,947,448 | A | 9/1999 | Lewis et al. | |
| 6,199,825 | B1 * | 3/2001 | Johnson et al. | 254/1 |
| 6,206,346 | B1 | 3/2001 | Johnson et al. | |
| 6,464,204 | B1 | 10/2002 | Johnson et al. | |

FOREIGN PATENT DOCUMENTS

| | | |
|---|---|---|
| BE | 509211 | 7/1953 |
| GB | 936353 | 8/1961 |
| GB | 916257 | 1/1963 |
| GB | 1350573 | 4/1974 |
| GB | 2485253 | 5/2012 |

OTHER PUBLICATIONS

GB1112349.4.

* cited by examiner

*Primary Examiner* — Lee D Wilson
*Assistant Examiner* — Shantese McDonald
(74) *Attorney, Agent, or Firm* — 4th Dimension IP

(57) ABSTRACT

A vehicle lift comprises a pair of parallel ramps (2) each of which is pivoted to an upstanding support (1) at one end, wherein the two ramps (2) are connected by a cross-beam (6) located towards the ends distal from the pivots (3) and rigidly secured to the ramps (2), which cross-beam (6) includes a lifting box (7) engageable with a lifting jack (12) and located substantially midway between the two ramps (2) such that lifting forces are directed through the center line of the cross-beam (6). The cross-beam (6) bears against the ground when the ramps (2) are in a downwards position. The jack (12) can be replaced by axle stands (10) when the ramps (2) are elevated.

13 Claims, 5 Drawing Sheets

VEHICLE LIFT

CROSS-REFERENCE TO RELATED APPLICATIONS

The present application is based on and claims priority from GB 1112349.4 which was filed on Jul.18, 2011.

FIELD

Embodiments of the invention relate to a lift for raising a three- or four-wheeled vehicle on its wheels in a substantially horizontal configuration, in order to enable work on or underneath the vehicle. The lift is particularly suitable for a small workshop or a private garage, in which storage or access space may be limited.

BACKGROUND AND RELATED ART

Most horizontal vehicle lifts are fixed structures intended for use in commercial garages. Such lifts are wider than the vehicles to be lifted. Typically, garage lifts have a lift height of at least 1.5 m and are powered by electric motors or hydraulic pressure. Commercial 1- to 4-post lifts are too wide, require too much headroom and are too expensive for general use, as well as being a fixed structure.

Alternative methods of raising a vehicle in a horizontal configuration include an elevated platform accessed by long ramps, which occupy excessive space both when attached to the elevated platform and, if detachable, when stored. Other methods include drive-on ramps which can then be tilted to a horizontal configuration. Such tilting lifts are inherently unstable and therefore require reliable locking mechanisms. These and other more complicated ramp lifts are generally too expensive, too heavy or too large for domestic use, or may have structures that limit access underneath a vehicle.

Many people attempt to raise the vehicle using a lifting jack, with or without axle stands or blocks to maintain the vehicle in an elevated position. This is potentially dangerous if one wishes to work underneath the vehicle and is difficult if one needs to elevate more than one wheel at the same time.

Another problem arises if a vehicle's ground clearance is less than the minimum height of the jack.

There is a need for a small lift to enable a person to work underneath a vehicle in a domestic garage or small workshop, or at the roadside. For this purpose, the possibility of raising a vehicle some 350 mm above its normal ground clearance gives good access to the underside, while reducing the risks of backache when working on the wheels, brakes, suspension, engine, interior and topsides.

U.S. Pat. No. 6,464,204 dated 15 Oct. 2002, of Danny L. Johnson et al. and assigned to Kwiklift, Inc., describes and claims a portable vehicle lifting apparatus comprising a pair of ramps pivoted at one end to base units and having a lifting bar pivotally connected between each ramp. The pivotal connection between the lifting bar and the ramps adds an additional complexity to the apparatus. When using a single jack, if the lifting force is offset from the centre line of the lifting bar, additional locking mechanisms are required to prevent rotation of the lifting bar. Also, in the absence of features to constrain the lifting force to the mid-span of the lifting bar, there may be a tendency for the ramps to twist relative to each other.

BE 509211 dated 29 Feb. 1952 of C. Hosay describes a similar apparatus to U.S. Pat. No. 6,464,204 but with no provision for a jack being used to elevate the ramps.

SUMMARY OF EMBODIMENTS

Embodiments of the present invention provide a vehicle lift suitable for a domestic garage or small workshop and enabling sufficient lift to provide working space underneath the vehicle without the risk and complexity of transferring the vehicle from a single jack to axle stands or blocks.

In some embodiments, a vehicle lift comprises a pair of parallel ramps each of which is pivoted to an upstanding support at one end and thereby movable between a substantially horizontal configuration and a slope downwards from the pivot, wherein the two ramps are connected by a cross-beam rigidly secured to the ramps and located towards the ends distal from the pivots but displaced therefrom such that the cross-beam bears against the ground when the ramps are in a downward position and wherein the cross-beam includes a jacking point engageable with a separable lifting jack and located substantially midway between the two ramps such that lifting forces are directed effectively through the centre line and mid-span of the cross-beam.

By "rigidly secured to the ramps" I mean that there is no significant relative movement, and especially no rotational movement, between the ramps and the cross-beam during elevation or lowering of the lift. The cross-beam can be welded to or otherwise integral with the ramps. Alternatively, and especially when it is desired for the lift assembly to be demountable, the cross-beam can engage with sockets or brackets on the ramps, provided that there is no relative movement, and especially no rotational movement. To ensure such rigidity, ideally the cross-section of at least the ends of the cross-beam is non-circular and the ends engage with corresponding sockets or brackets on the ramps. For example, the cross-section may be square, rectangular, T- or I-shaped.

In some embodiments, the vehicle can be driven or manipulated up the inclined ramps forming the lift. The ramps, and therefore the vehicle, may then be elevated to a substantially horizontal position using a single jack in a balanced and safe manner. The cross-beam may then be supported on axle stands or similar stable supports and the jack is removed, thereby increasing access to the underside of the vehicle from the ends and the sides of the lift.

The jack may be operated from behind or beneath the vehicle.

In some embodiments, the jacking point comprises a structure enveloping a portion of the jack and particularly a lifting box engageable with the saddle of a floor or trolley jack. The jacking point may include one or more adjustable spacers to accommodate different sizes of jack and, importantly, to centralise the lifting member of the jack. The spacers may be made of any convenient material, such as metal, plastics or wood. Alternatively or concurrently, a set of interchangeable lifting boxes of different sizes may be utilised.

If required, the vehicle may be temporarily secured in conventional manner in any position along the lift or may be moved backwards and forwards according to the requirements of the job.

In some embodiments, in order to enable the vehicle to be driven or manipulated up the inclined ramps, it will be apparent that any projection of the jacking point above the plane of the ramps must be below the ground clearance of the vehicle where it passes over the jacking point. This can be inherent in the structure of the cross-beam and jacking point. Alternatively, the jacking point may be detachable from the cross-beam and secured in position after the vehicle has cleared its location to enable elevation of the ramps.

In order to accommodate any change in angle between the lifting member of the jack and the jacking point during movement of the ramps, a resilient pad may be included between a bearing surface of the jacking point and a lifting member of the jack.

In some embodiments, for the cross-beam to be load-bearing when the ramps are in a downward position it must project below the underside of the ramps. Depending on the angle of the ramps in a downwards position, the faces of the lifting bar and jacking point bearing against the ground may be chamfered, to improve the stability of the lift assembly.

Conveniently, the height of the pivots above the ground is adjustable, to accommodate different lift heights. The pivots may engage with and be slideable along a substantially vertical track on the upstanding supports, and then locked in a chosen position in conventional manner. Alternatively, each pivot may engage with one of a series of vertically spaced holes in the corresponding support or a set of interchangeable supports of different heights may be utilised.

In order to maintain stability of the lift when a vehicle is being driven up or down the ramps while potentially enabling utilisation of materials of lesser strength and stiffness, the maximum bending moment should occur in spans that are less than the overall length of the ramps. The maximum bending moment when a vehicle is being driven or manoeuvred on the ramps occurs when the advancing wheels are halfway along the span between the point of contact with the ground and the upstanding supports. Displacement of the cross-beam inwards of the ends of the ramps reduces the length of this span and therefore the bending moment.

In order to adjust the slope of the ramps, the positioning of the cross-beam along the ramps may be adjustable. This arrangement is particularly convenient when combined with adjustable pivot height, as discussed above. As a matter of geometry, the cross-beam may be positioned along the ramps according to the formula:

$$B = C \arctan \theta$$

wherein B is the displacement from the unpivoted ends of the ramps;

C is the projection of the cross-beam below the underside of the ramps; and

θ is the slope angle of the ramps in a downward position.

Displacement of the cross-beam inwards of the ends of the ramps may have the further advantage that the minimum height of the jack can exceed the ground clearance of the vehicle when it is on level ground. In order for the vehicle to clear the lifting box when it is being driven or manoeuvred up the ramps, the maximum height of the lifting box above the ground must be less than the projection C plus the ground clearance of the vehicle. Addition of C to the parameters determining such clearance enables a jack to be moved along the ground between the inclined ramps and underneath a vehicle elevated on the ramps and the saddle inserted within the lifting box, even though the jack's minimum lifting height and/or body height may be greater than the ground clearance of the vehicle on level ground.

Conversely, the lower the acceptable internal height of the lifting box, the higher the potential lift height for a specific jack. The various parameters can be readily adjusted accordingly.

In some embodiments, the spacing of the parallel ramps is adjustable to accommodate different vehicle track widths. The cross-beam then comprises sections longitudinally movable relative to each other. Conveniently, the longitudinally movable sections of the cross-beam may engage each other telescopically. For example, the longitudinally movable sections of the cross-beam can be locked in position in conventional manner.

In order to increase the stiffness of the overall assembly, the lift may incorporate a second cross-beam also bearing against the ground when the ramps are in a downward position, wherein the jacking point acts on both cross-beams. When such second cross-beam is included, the lift may incorporate a third ramp located between the paired ramps and supported by both cross-beams. This third ramp is particularly useful for three-wheeled vehicles. As above, the jacking point may be detachable from the cross-beams and secured in position after the vehicle has cleared its location to enable elevation of the ramps.

The ramps may be made of any conventional material. Each ramp may be a single structure or comprise several sections in known manner. The ends of the ramps remote from the pivots may terminate in a hinged extension piece.

The lift can readily be operated by one person using a single jack. Particularly when space is limited, the vehicle may be stored on the fully-assembled lift inside a garage or other shelter.

Especially when configured for small or medium sized vehicles, the lift assembly may be small and light enough to be readily portable. It may be disassembled for storage or transport. As well as being convenient for a private garage or small workshop, the lift may be used out of doors, for example at the roadside or as a display stand on a garage forecourt. With suitable configuration of the ramps, the lift assembly can readily be adapted for boats, ride-on mowers or other structures.

Figure 1:
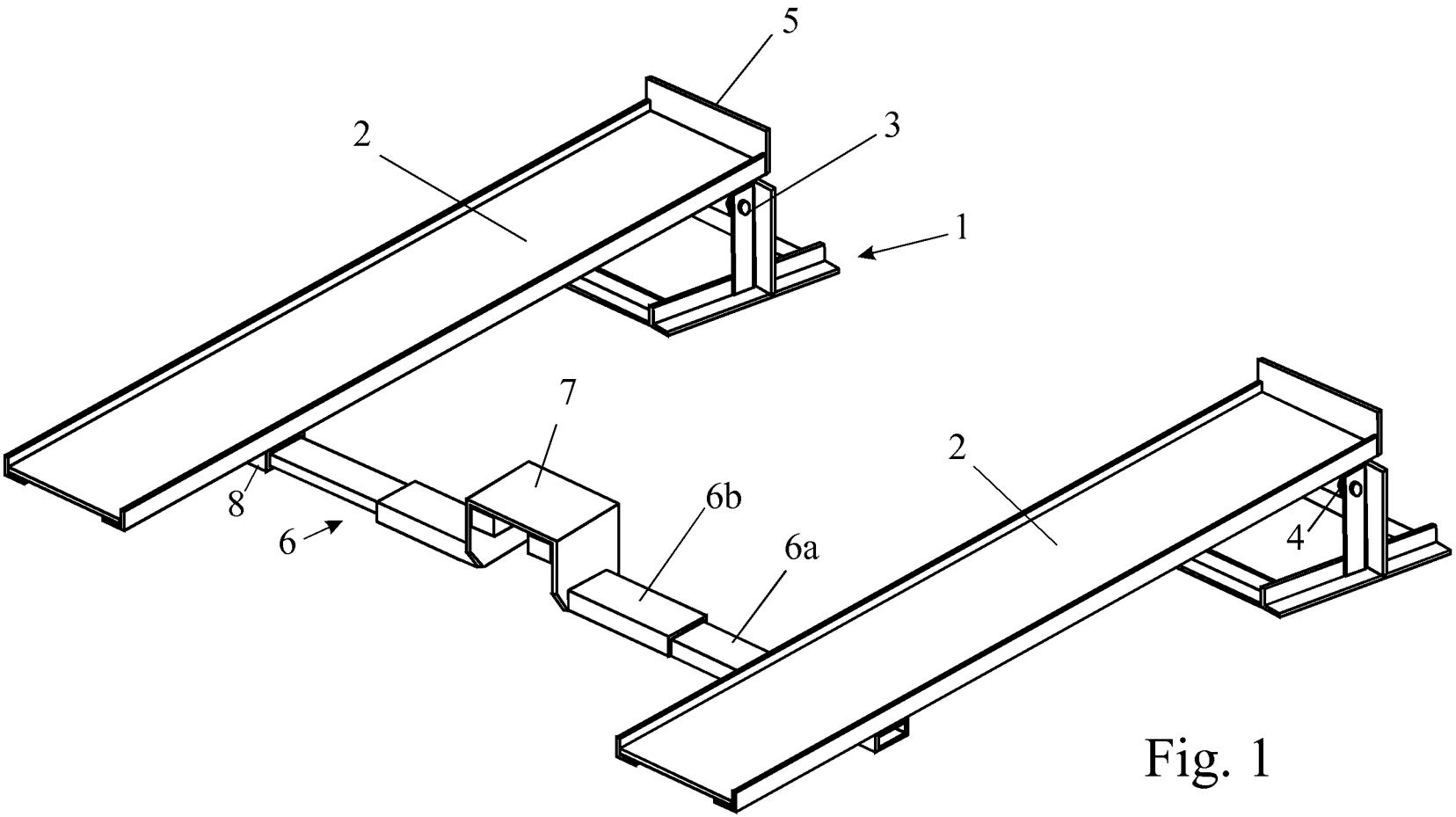
FIG. 1 is a perspective view of a vehicle lift according to presently-disclosed embodiments.

The vehicle lift of FIG. 1 comprises a pair of supports 1, to each of which is attached a ramp 2. For each ramp 2, a pivot 3 passes through a bracket 4 on the underside of the ramp 2 and through a hole in support 1, thereby pivotally securing the ramp 2 to the upstanding support 1. The upper end of each ramp is terminated by a stop 5.

The ramps 2 are interconnected by a cross-beam 6 incorporating a lifting box 7 midway between the ramps 2. As is shown more clearly in FIG. 3, the lifting box 7 constrains the lifting member of an associated jack 12 and is so positioned that lifting forces applied by the jack 12*a* are directed vertically through the centre line of the cross-beam 6. As indicated diagrammatically in FIG. 2, the cross-beam 6 and the lifting box 7 bear against the ground when the ramps are in a downward position. It is self-evident that the cross-beam 6 and lifting box 7 must be strong enough to support the weight of the ramps and a vehicle being loaded thereon.

The cross-beam 6 comprises several, in this case two, telescopic sections, 6*a* and 6*b*, on either side of the centrally mounted lifting box 7. The cross-beam 6 is shown as a rectangular section girder engaging in a correspondingly shaped socket 8 on the underside of each ramp 2 but other configurations, for example welding, are possible provided that the cross-beam 6 is rigidly secured to the ramps 2. The two parallel ramps 2 may be moved further apart or closer together as required to accommodate different vehicle track widths.

Each ramp 2 is shown as a single component but they can readily comprise interlocking sections in known manner. The ramp may terminate in a hinged extension piece (not shown) in known manner to allow for irregularities in the floor or ground surface.

The lift may be constructed of any convenient material strong enough to take the expected loads without excessive deformation, such as mild steel or an aluminium alloy.

Figure 2:
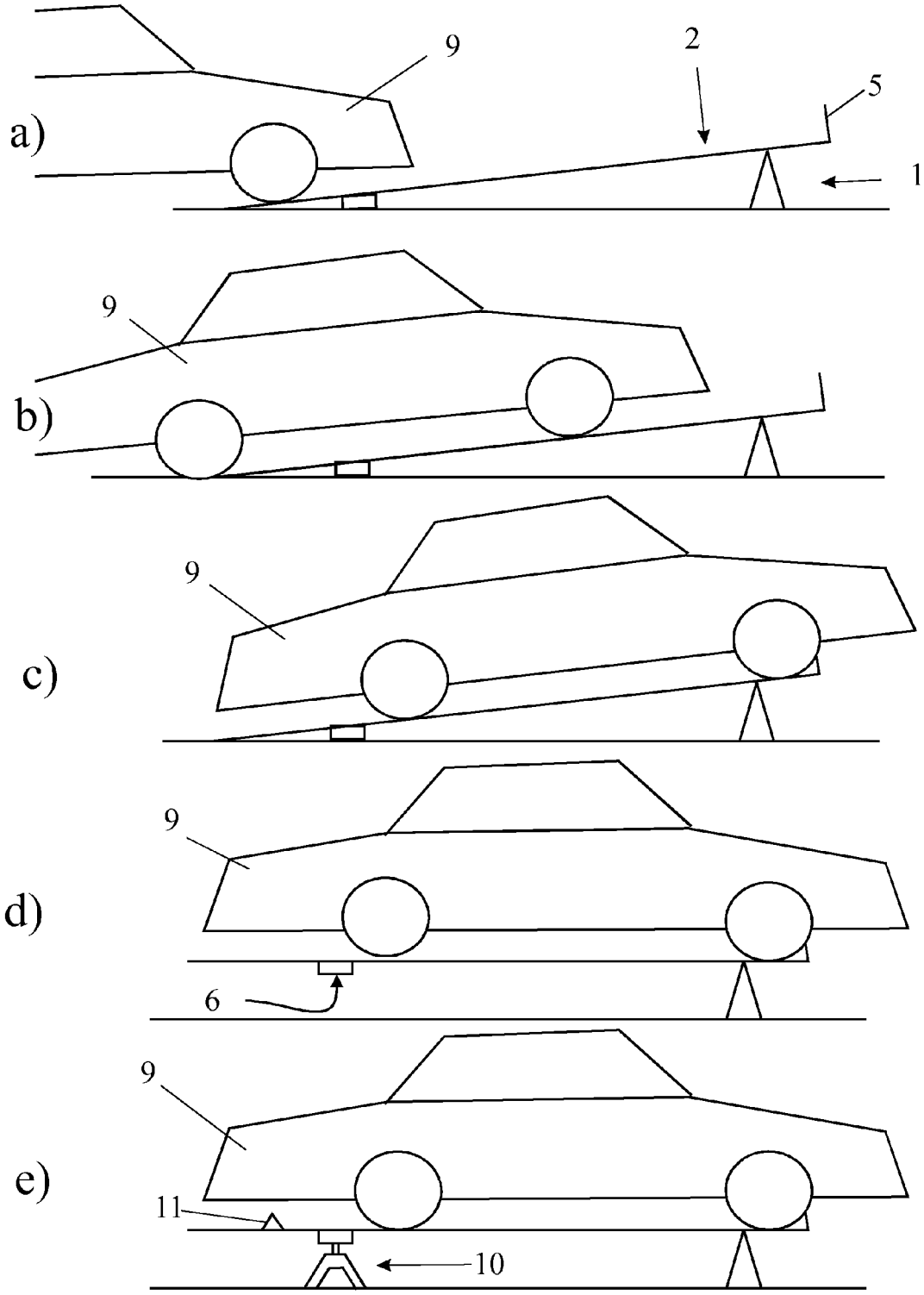
FIGS. 2*a*)-2*e*) are a series of diagrams showing sequential stages in the elevation of the lift assembly.
Figure 3A:
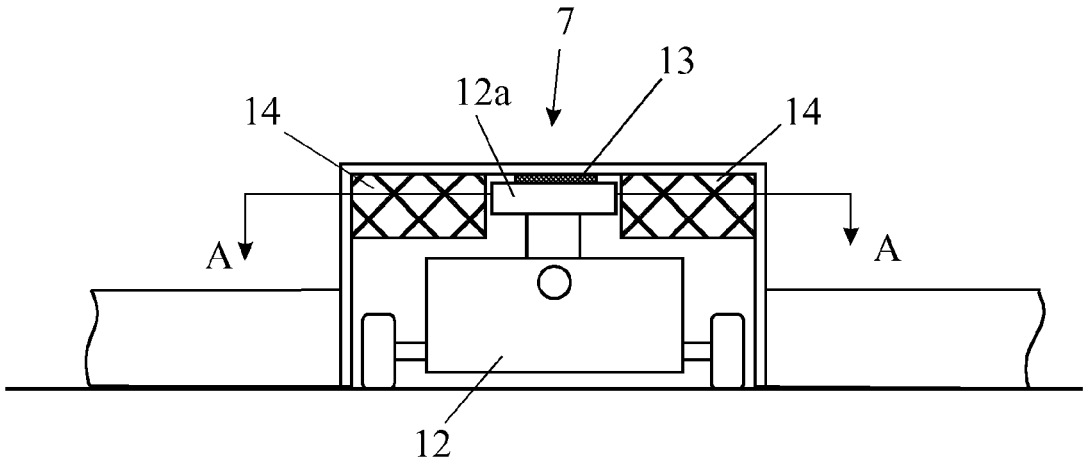
FIG. 3A is a view, partially in section, showing engagement of a trolley jack with the lifting box.
Figure 3B:
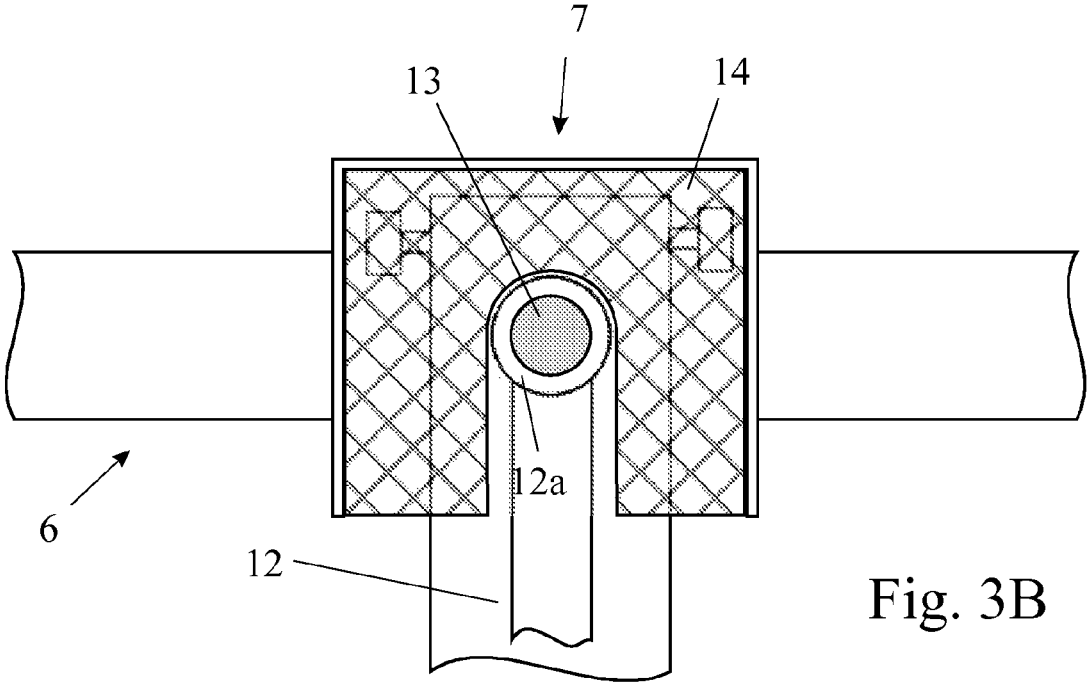
FIG. 3B is a top view on the line A-A of FIG. 3A.

As shown diagrammatically in FIG. 2, the lift is operated by driving or otherwise manipulating a vehicle 9 up two gently inclined ramps 2. Once the vehicle 9 is in the desired position on the ramps 2, a single trolley jack or equivalent (not shown in FIG. 2) is applied to the lifting box forming part of cross-beam 6 in order to raise the ramps 2 to a substantially horizontal position, pivoting on the upstanding supports 1. As shown in FIGS. 1 and 3, the lifting box 7 positions and fixes the jack accurately under the lift assembly, enabling a balanced and safe lift. Stability and safety may be further increased by placing axle stands or similar stable structures 10 under the raised ends of the ramps 2 after completion of the lift, for example under the strong point constituted by the cross-beam 6. The jack may then be removed to leave the underside of the vehicle 9 and the floor space more accessible.

The vehicle 9 may be retained in position in conventional manner, for example by affixing a chock or stopper 11 to the ramp 2. Alternatively, the ramps may be raised slightly above a horizontal position, so that gravity urges the vehicle against the end stops 5.

The vehicle 9 may be removed from the lift assembly by reversing the above procedures. In some embodiments, the jack is re-engaged in the lifting box 7 and employed to lower the ramps 2 in a controlled manner. The vehicle 9 may be allowed to roll off the ramps by gravity alone.

FIG. 3 shows a jack 12 in position under the lifting box 7. The lifting box 7 surrounds the body of the jack 12. The saddle 12*a* of the jack bears against a resilient pad 13 within the lifting box 7. A removable spacer 14 engages with the saddle 12*a* and locates the saddle 12A in a central position.

Figure 4A:
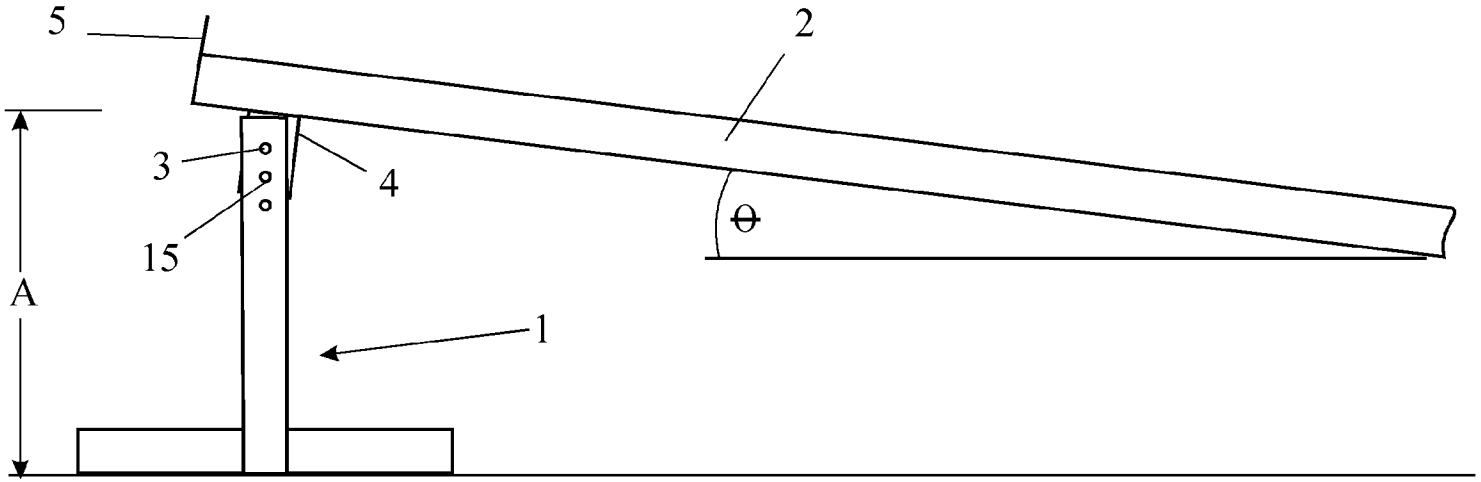
FIGS. 4A and 4B are partial views indicating adjustable pivot heights and adjustable cross-beams, respectively.
Figure 4B:
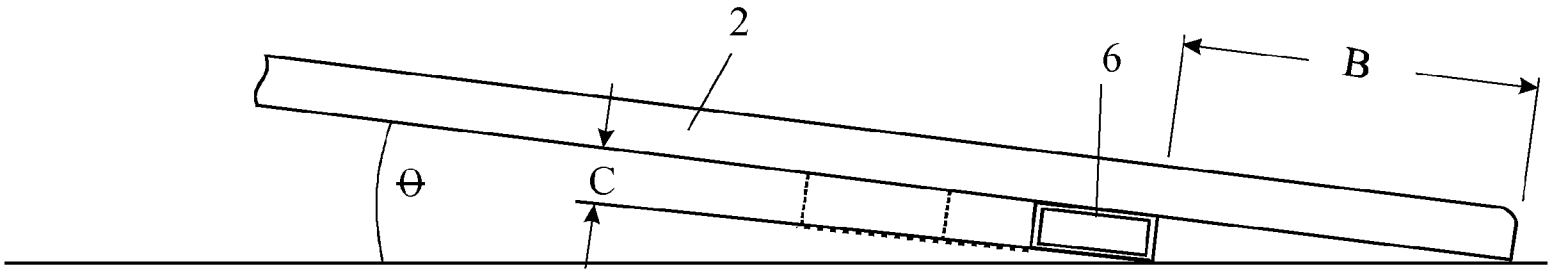

FIG. 4 shows an alternative configuration of lift assembly wherein both the pivot height and the position of the cross-beam along the ramp are adjustable. FIG. 4A shows a support 1 with several holes 15 for receiving pivot 3. FIG. 4B shows a cross-beam 6 below a ramp 2 with alternative positions of the cross-beam indicated by broken lines.

In FIG. 4:

A is the height of the pivot 3 above the ground;

B is the displacement of the cross-beam 6 from the unpivoted end of the ramp 2;

C is the projection of the cross-beam 2 below the underside of the ramps 2; and θ is the slope angle of the ramps 2 in a downward position.

It will be apparent that, when the cross-beams 2 are bearing on the ground:

$$B = C \arctan \theta$$

Within the limits of displacement of the pivot height and the cross-beam location, the height A and slope θ are adjustable as required.

Figure 5:
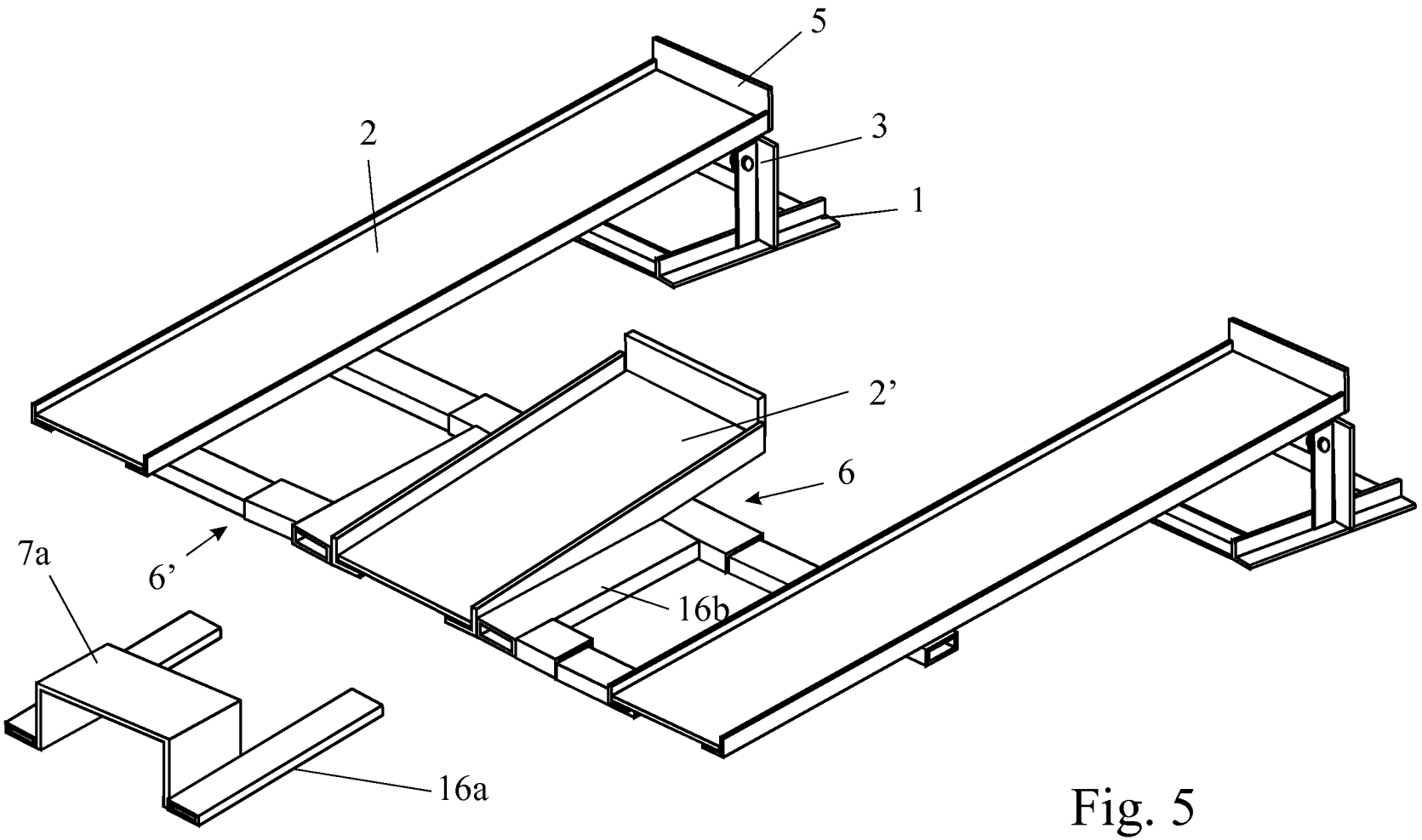
FIG. 5 is a perspective view of an alternative configuration of a vehicle lift, incorporating a third ramp and a second cross-beam.

FIG. 5 shows an alternative form of lift suitable for a three-wheeled vehicle.

The lift of FIG. 5 is identical with that of FIG. 1 but with the addition of a second or supplementary telescopic cross-beam 6' joining the ends of ramps 2 distal from the supports 1 and pivots 3. The two cross-beams 6 and 6' bear a third ramp 2' parallel to and in the plane of the outer ramps 2.

In some embodiments, cross-beam 6 and supplementary cross-beam 6' are so positioned that both cross-beams bear against the ground when the ramps are in a downward position.

In use, the vehicle is driven or manipulated up the ramps 2 and 2' so that the outer wheels are on the outer ramps 2 and the central wheel is on the third ramp 2'. In order to provide clear access to the third ramp 2', lifting box 7A is demountable and is secured to cross-beams 6 and 6' after the vehicle is in position on the ramps 2 and 2'. Lifting box 7A bears two projecting stubs 16*a*, which can engage in corresponding receptacles 16*b* secured to the cross-beams 6 and 6'.

It will be appreciated that the demountable lifting box 7A need not be associated with a third ramp but is also useful to enable vehicles with a low ground clearance to be driven or manipulated up the ramps without fouling the lifting box. Similarly, the lifting box may be secured to the cross-beam or beams in any convenient manner.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art.

The invention claimed is:

1. A vehicle lift comprising a pair of parallel ramps each of which is pivoted to an upstanding support at one end and thereby movable between a substantially horizontal configuration and a slope downwards from the pivot, wherein (a) the two ramps are connected by a cross-beam rigidly secured to the ramps and located towards the ends distal from the pivots but displaced therefrom such that the cross-beam bears against the ground when the ramps are in a downward position; (b) the cross-beam includes a jacking point engageable with a separable lifting jack and located substantially midway between the two ramps such that lifting forces are directed effectively through the centre line and mid-span of the cross-beam; and (c) the jacking point comprises a lifting box engageable with a lifting member of a floor or trolley jack.

2. A vehicle lift as claimed in claim 1 wherein the jacking point includes at least one adjustable spacer centralising the lifting member within the lifting box.

3. A vehicle lift as claimed in claim 2 including a resilient pad between a bearing surface of the jacking point and the lifting member of the jack.

4. A vehicle lift as claimed in claim 1 wherein the positioning of the cross-beam along the ramps is adjustable.

5. A vehicle lift as claimed in claim 1 wherein the jacking point is detachable from the cross-beam.

6. A vehicle lift as claimed in claim 1 wherein the cross-section of at least the ends of the cross-beam is non-circular and the ends engage with corresponding sockets or brackets on the ramps.

7. A vehicle lift as claimed in claim 1 wherein the spacing of the parallel ramps is adjustable to accommodate different vehicle track widths.

8. A vehicle lift as claimed in claim 7 wherein the cross-beam comprises sections longitudinally movable relative to each other.

9. A vehicle lift as claimed in claim 8 wherein the longitudinally movable sections of the cross-beam engage each other telescopically.

10. A vehicle lift as claimed in claim 8 wherein the longitudinally movable sections of the cross-beam can be locked in position.

11. A vehicle lift as claimed in claim 1 wherein the height of the pivots above the ground is adjustable.

12. A vehicle lift comprising a pair of parallel ramps each of which is pivoted to an upstanding support at one end and thereby movable between a substantially horizontal configuration and a slope downwards from the pivot, wherein the two ramps are connected (a) by a cross-beam rigidly secured to the ramps and located towards the ends distal from the pivots but displaced therefrom such that the cross-beam bears against the ground when the ramps are in a downward position; and (b) by a second cross-beam also bearing against the ground when the ramps are in a downward position, and wherein the cross-beams include a jacking point acting on both cross-beams and engageable with a separable lifting jack, which jacking point is located substantially midway between the two ramps such that lifting forces are directed effectively through the centre lines and mid-span of the cross-beams.

13. A vehicle lift as claimed in claim 12 incorporating a third ramp located between the paired ramps and supported by both cross-beams.

* * * * *